US007237295B2

(12) United States Patent
Lindholm

(10) Patent No.: US 7,237,295 B2
(45) Date of Patent: Jul. 3, 2007

(54) SURFACE CLEANING DEVICE

(75) Inventor: Keijo Lindholm, Salo (FI)

(73) Assignee: Carl Freudenberg KG, Weinheim (DE)

( * ) Notice: Subject to any disclaimer, the term of this patent is extended or adjusted under 35 U.S.C. 154(b) by 262 days.

(21) Appl. No.: 10/974,587

(22) Filed: Oct. 27, 2004

(65) Prior Publication Data

US 2005/0091775 A1 May 5, 2005

(30) Foreign Application Priority Data

Nov. 3, 2003 (DE) ..... 103 51 536

(51) Int. Cl.
*A47L 13/258* (2006.01)

(52) U.S. Cl. ..... 15/147.2; 15/228; 15/229.6; 15/229.8

(58) Field of Classification Search ..... 15/147.1, 15/147.2, 228, 229.1, 229.6, 229.7, 229.8, 15/233
See application file for complete search history.

(56) References Cited

U.S. PATENT DOCUMENTS 1,069,960 A * 8/1913 Kubick ..... 15/229.2
2,325,598 A * 7/1943 Failand ..... 15/147.2
2,921,327 A * 1/1960 Kuehl ..... 15/147.1
3,050,762 A * 8/1962 Ballinger ..... 15/147.1
3,395,415 A 8/1968 Leland
4,070,726 A * 1/1978 Joffre ..... 15/231
4,564,914 A 1/1986 Ballough et al.
4,564,969 A * 1/1986 Heinonen ..... 15/147.2
5,253,387 A * 10/1993 Kresse et al. ..... 15/228
5,390,390 A * 2/1995 Kresse et al. ..... 15/228
5,455,980 A 10/1995 Buchanan
5,864,914 A 2/1999 Salmon

FOREIGN PATENT DOCUMENTS

DE 9415002 U1 9/1994
DE 201 14 744 11/2001
EP 0599 227 6/1994
JP 2002-282185 * 10/2002

* cited by examiner

*Primary Examiner*—Mark Spisich
(74) *Attorney, Agent, or Firm*—Kenyon & Kenyon LLP

(57) ABSTRACT

A surface cleaning device including a planar wiping trimming carrier and a handle connected to the wiping trimming carrier by a joint. The joint has a swivel axis which extends parallel to the longitudinal direction of the wiping trimming carrier, so as to be able optionally to swivel the one or the other main side of wiping trimming carrier into a position that extends parallel to a surface to be cleaned, the wiping trimming carrier being provided at at least one end with an extension that is shiftable along the former's longitudinal extension in the direction towards the joint.

16 Claims, 2 Drawing Sheets

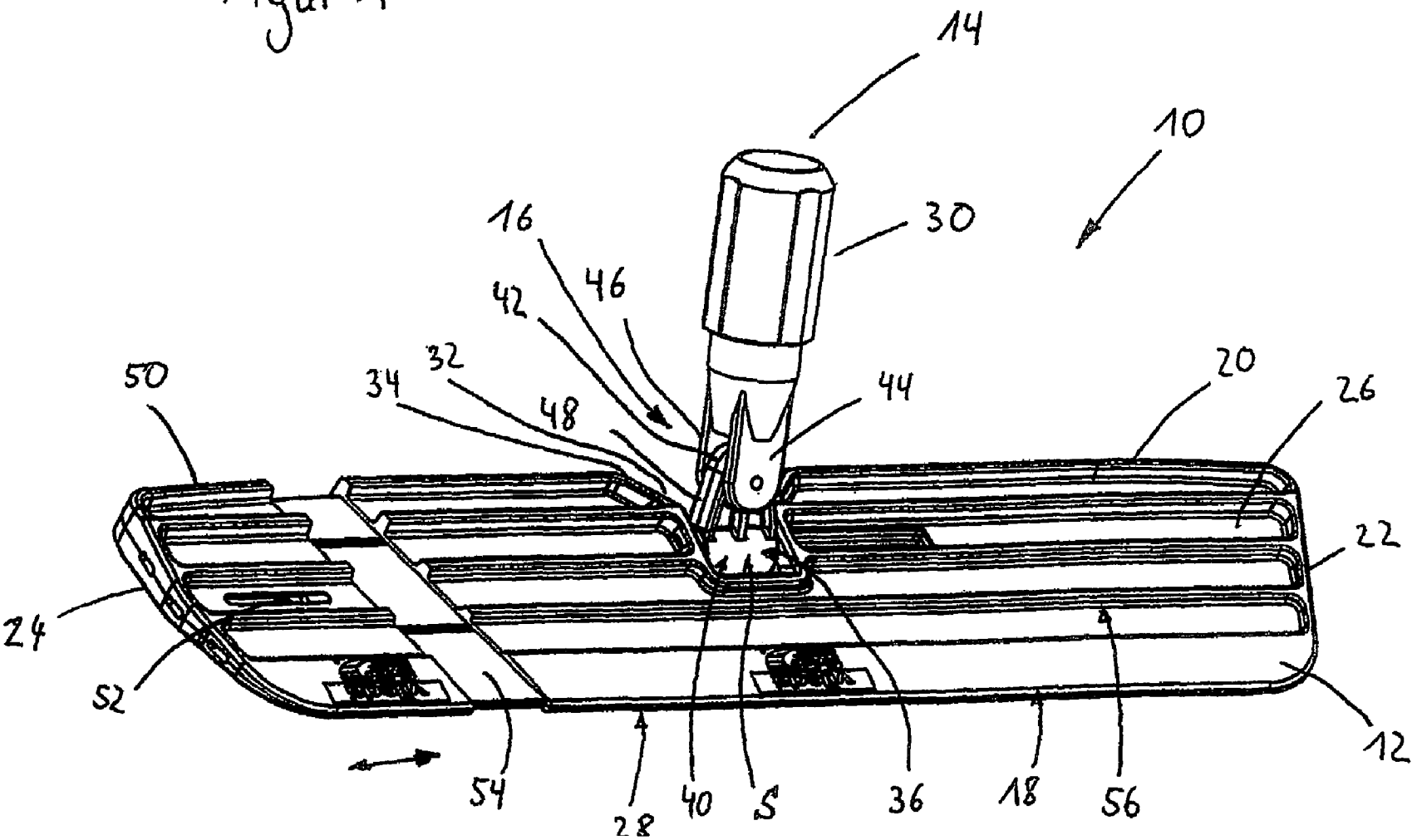
Figur 1

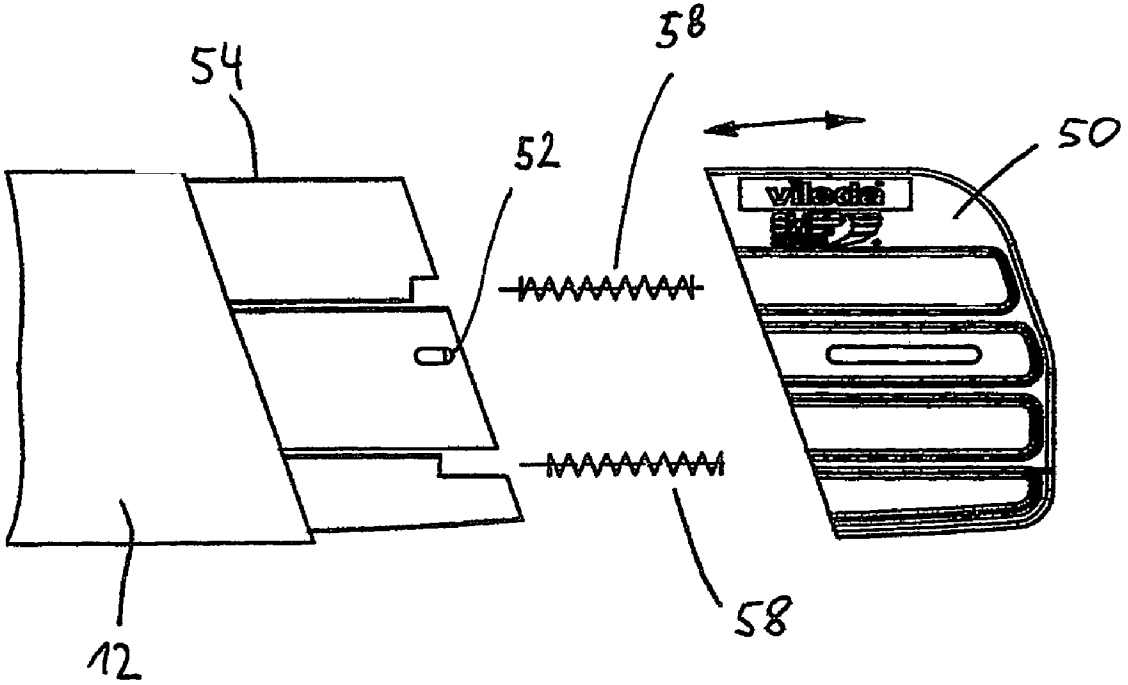
Figur 2

SURFACE CLEANING DEVICE

FIELD OF THE INVENTION

The present invention relates to a surface cleaning device.

BACKGROUND INFORMATION

Conventional surface cleaning devices are described, for example, in German Utility Patent DE 9415002 U1, which includes a wiping trimming carrier and a handle connected to the wiping trimming carrier by a joint. The joint system is located in the edge region of the wiping trimming carrier, and permits the wiping trimming carrier to be used on both sides. With this design, the wiping covers may be designed such that they are made either on both sides of the same material, or of different materials adapted to certain application cases, and may be used on both sides-without manual effort. This embodiment allows high surface efficiency and a long service life of the wiping cover.

Surface cleaning devices are also described and illustrated in European Patent Application EP 0 599 227 A1, wherein the wiping trimming carrier can only be provided with a wiping cover on the underside of the plate. In these wiping trimming carriers, a device is provided for tightly mounting the wiping cover on the wiping trimming carrier. Because of that, even with intensive use, such as in the professional field of use, the wiping covers are not able to detach from the wiping trimming carrier.

The disadvantage with conventional surface cleaning devices is that the wiping covers are not exchangeable between the two unit types described. The wiping trimming carriers are in each case developed such that the carriers may accommodate either a wiping cover usable on both sides or one that is usable only on one side.

SUMMARY OF THE INVENTION

The present invention is based on the objective of further developing the surface cleaning device of the species such that the surface cleaning device is suitable for accommodating wiping covers that may be used on both sides, and that the surface cleaning device may accommodate wiping covers of different width extensions.

This objective is attained according to the present invention by a surface cleaning device described and illustrated.

In order to attain the objective, in an example embodiment according to the present invention, the joint for connecting the wiping trimming carrier to the handle has a swivel axis which extends parallel to the longitudinal direction of the wiping trimming carrier, so that optionally the one or the other main side of the wiping trimming carrier may be swiveled into a position extending in parallel to a surface to be cleaned, and, in addition, the wiping trimming carrier is furnished, at at least one end, with an extension that is shiftable along its longitudinal extension in the direction towards the joint.

The positioning of the joint, having a swivel axis that extends in the longitudinal direction, allows swiveling the wiping trimming carrier, and therewith the use of a wiping cover that is usable on both sides. At the same time, the extension allows the mounting and tightening of wiping trimmings which are able to be used only on one side. Another advantage is that wiping covers of various sizes may also be mounted.

Because of the tightening of the wiping covers, the formation of creases in the wiping covers that are stretched by cleaning fluid is prevented. Thereby the wiping result is made uniform, and no streaks are formed. Furthermore, the wiping covers are not able to detach from the wiping trimming carrier, even during intensive utilization.

According to one exemplary embodiment, the joint is situated in a laterally open cut-through in the wiping trimming carrier. Expediently, a swivel axis of the joint is situated in the region of the center of gravity. Consequently, the wiping trimming carrier keeps its original working position or angular position when it is lifted up, whereby a clearly improved performance is made possible, especially during the cleaning of stair steps.

The extension may enclose the wiping trimming carrier on the outside, as a sleeve fitted to its profile, whereby clamping of the wiping cover between the wiping trimming carrier and the extension during mounting or removal may be prevented. Because of the sleeve shape, the extension encloses the wiping trimming carrier entirely. This reduces the danger of injury to the cleaning personnel. In addition, the construction is especially robust and ensures a good guidance of the extension on the wiping trimming carrier.

Preferably, the wiping trimming carrier and the extension have a profile that essentially matches, as well as an essentially matching cross section. Because of the matching cross section, a uniform contact pressure of the wiping cover on the surface that is to be cleaned is ensured over the entire wiping surface, which is composed of the wiping trimming carrier and the extension. This prevents the formation of streaks, on the surface to be cleaned, because of nonuniform contact pressure of the wiping cover.

The bracing of the wiping cover may basically be carried out by the application of an engaging mechanism or a snap-on connection between wiping trimming carrier and extension. In an exemplary embodiment, the extension may be able to be pushed in against the force of a spring. It is expedient to use a pressure spring, such as a helical spring, whereby, even with frequent use, a reliable possibility is created for the reversible adjustment of the extension. Furthermore, the spring makes possible a constant tightening of the wiping trimming on the wiping trimming carrier if the wiping trimmings have different sizes, or if they stretch during use.

In an additional exemplary embodiment of the present invention, the extension may be stopped in a pushed-in and/or an extended state. The stopping allows an easier mounting and removal of the wiping cover, and the expenditure of force during the mounting of the wiping cover for the cleaning personnel is lessened, since cleaning personnel do not have to pull on the wiping cover against the force of a spring. By stopping the extension in the extended state, during intensive utilization, the extension is not able to be pushed in, nor thereby is the wiping cover able to be loosened.

Depending on the application, the surface cleaning device may be manufactured of aluminum or stainless steel. The use of metallic materials ensures the greatest stability and durability of the surface cleaning device, especially in the case of professional application purposes.

The surface cleaning device may be made of plastic, such as polypropylene. The use of plastic allows economical and simple manufacturing at sufficient stability and durability.

A combination of metallic materials and plastic permits, depending on the load applied, making the individual components of the respectively most cost-effective materials. In this context, metallic materials come into consideration particularly for producing the joint, and plastics for producing the wiping trimming carrier and the handle.

The wiping trimming carrier, as well as the extension, may have a profile that tapers in the forward direction in the shape of a wedge. This simplifies putting a cover on the wiping trimming carrier by the cleaning personnel, and it simplifies cleaning narrow areas that are difficult to access.

The wiping trimming carrier may be provided with ribs on its longitudinal extension. Given the use of a minimum quantity of material, the ribs ensure maximum firmness of the wiping trimming carrier.

A wiping trimming carrier that is trapezoidal in top view in design may be used, for example, the front longitudinal edge being longer than the rear longitudinal edge, and the side surfaces subtending an angle of 20° to 100°, expediently from 30° to 90°. Because of the trapezoidal shape of the wiping trimming carrier, the radius of action of the cleaning personnel is increased, and the cleaning of corners is simplified.

Extension by a path limiter may be shifted only within constructively specified limits. This ensures that the extension always has a sufficient guideway on the wiping trimming carrier, and that the extension is not able to detach itself from the wiping trimming carrier.

Beginning at the second swivel axis of the universal joint, the recess may open in a V shape to the rear longitudinal side, the opening angle being 60° to 120°, expediently 70° to 100°. This increases the radius of action when one is cleaning surfaces that are difficult to reach, such as under cupboards or shelves, since the V-shaped recess permits a swiveling of the wiping trimming carrier about the second swivel axis, even when there is a very acute angle between the wiping trimming carrier and the handle.

BRIEF DESCRIPTION OF THE DRAWINGS

FIG. 1 is a top view of the surface cleaning device in spatial representation.

FIG. 2 is a view of a wiping trimming carrier having an extension and the positioning of the spring.

DETAILED DESCRIPTION

Surface cleaning device 10 includes a wiping trimming carrier 12 and a handle 14, which may be either a handle [broomstick] operated by hand or it may be a component of a motor-driven cleaning or maintenance device. Handle 14 is connected to wiping trimming carrier 12 in a swiveling manner via a universal joint 16. Wiping trimming carrier 12 is a flat, plate-shaped trapezoidal element provided with ribs 56, having two longitudinal sides 18, 20 that run at an acute angle to each other, having two narrow sides 22, 24 that run approximately perpendicular, slightly wedge-shaped, to the former sides, and having opposite main sides 26, 28. The wedge shape of the wiping trimming carrier is designed such that rear longitudinal side 20 is formed broader in cross section than front longitudinal side 18, so that upper side and lower side 26, 28 in cross section form an acute angle. Universal joint 16 includes a connecting element 30 for the detachable fastening of handle 14.

The flat, plate-shaped wiping trimming carrier 12 is furnished with a U-shaped recess 32, which extends laterally through the thickness of the plate of wiping trimming carrier 12, and at the longitudinal middle of the thicker longitudinal side 20 it extends laterally through the thickness of the plate of wiping trimming carrier 12. Towards rear longitudinal side 20, the recess has a V-shaped widening 34. The depth of the cut out U-shaped recess 32 reaches into the area of the center of gravity S of wiping trimming carrier 12, such that a first swivel axis 36 may be positioned fixedly, in this center of gravity region, parallel to the main axis of wiping trimming carrier 12 or to the two longitudinal sides 18, 20 of wiping trimming carrier 12, close to, and parallel to a floor of U-shaped recess 32. The distance of first swivel axis 36 from the floor of U-shaped recess 32 is selected so that universal joint 16 or wiping trimming carrier 12, respectively, are able to be swiveled about the first, fixed swivel axis 36 of wiping trimming carrier 12 over an angle of about 180° of each of the two main sides 26, 28, so that both main sides 26, 28 may form a working area provided with a wiping trimming.

Universal joint 16 is made of plastic or a metallic material, and has a rotary joint 36 for fastening universal joint 16 to wiping trimming carrier 12. Rotary joint 36 is formed by a joint eyelet 40 and a joint pin. The joint pin is supported in the longitudinal extension of the wiping trimming carrier. Rotary joint 36 forms the first swivel axis. Above rotary joint 36, a joint fork 44 having joint cheeks 46, which are situated parallel at a distance to each other, is affixed via a connecting link 48. This joint fork 44 having joint cheeks 46 forms a second swivel axis 42 which is situated at an axial distance with respect to first swivel axis 36 rotated by 90° about the longitudinal axis of universal joint 16. Joint fork 44 is designed in one piece at its upper end to have a connecting tube end, to which a connecting element 30 is fastened, for fastening the lower end of the handle, for instance, by clamping, screwing or by a bayonet catch.

Planar wiping trimming carrier 12, in a lateral section, has an extension 50 which is supported on a guideway 54 of wiping trimming carrier 12, and is freely movable in the longitudinal direction of wiping trimming carrier 12. In order to limit the path length of extension 50 on guideway 54 of wiping trimming carrier 12, a path limiter 52 is affixed to wiping trimming carrier 12, which specifies the motion of extension 50, only within certain limits. The extension is there for the purpose of accommodating wiping covers that are provided for utilization on one or both sides, and which are able to be fastened onto the wiping trimming carrier in different sizes.

FIG. 2 shows wiping trimming carrier 12 and extension 50 supported on a guidance 54. Laterally on guidance 54 a compression spring 58 is applied in a bore, which is supported counter to extension 50. Consequently, the extension is under tension in the spring in the direction of wiping trimming carrier 12, and, after being pressed in, the extension returns on its own to its original position.

What is claimed is:

1. A surface cleaning device comprising:

a planar wiping trimming carrier; and a handle connected to the wiping trimming carrier by a joint, the joint having a swivel axis which extends parallel to a longitudinal direction of the wiping trimming carrier so as to be able to swivel at least one of a first and a second main side of the wiping trimming carrier into a position that extends parallel to a surface to be cleaned, wherein the wiping trimming carrier is provided at at least one end with a movable extension that is configured to be shifted along a longitudinal extension of the carrier in a direction towards the joint, the longitudinal extension having a top and bottom major planar surface, wherein the movable extension is a sleeve disposed about at least one of the top major planar surface and the bottom major planar surface of the longitudinal extension of the wiping trimming carrier.

2. The surface cleaning device according to claim 1, wherein the joint is situated in a laterally open cut-through of the wiping trimming carrier.

3. The surface cleaning device according to claim 1, wherein the extension encloses the wiping trimming carrier on an outside and the sleeve is adapted to a profile of the carrier.

4. The surface cleaning device according to claim 1, wherein the extension and the wiping trimming carrier, with respect to an outer cross section, have an essentially corresponding profile and an essentially corresponding cross section.

5. The surface cleaning device according to claim 1, wherein the extension is configured to be pressed in against a force of a spring.

6. The surface cleaning device according to claim 1, wherein the extension is configured to be stopped in at least one of a pressed-in state and an extended state.

7. The surface cleaning device according to claim 1, wherein wiping trimming carrier, the joint and the extension are made of one of aluminum and stainless steel.

8. The surface cleaning device according to claim 1, wherein the wiping trimming carrier, the joint and the extension are made of plastic.

9. The surface cleaning device according to claim 1, wherein the wiping trimming carrier, the joint and the extension are made of a combination of at least one of aluminum, stainless steel and plastic.

10. The surface cleaning device according to claim 1, wherein the wiping trimming carrier and the extension have a profile in a shape of a wedge that tapers in a forward direction.

11. The surface cleaning device according to claim 1, wherein the wiping trimming carrier is provided with ribs in the longitudinal direction.

12. The surface cleaning device according to claim 1, wherein a front longitudinal side is longer than a rear longitudinal side, and side surfaces subtend at an angle of 20° to 100°.

13. The surface cleaning device according to claim 1, wherein the wiping trimming carrier is trapezoidal, a front longitudinal side being longer than a rear longitudinal side, and side surfaces subtending at an angle of 30° to 90°.

14. The surface cleaning device according to claim 1, wherein a path limiter permits a shifting of the extension only within constructively specified limits.

15. The surface cleaning device according to claim 1, wherein beginning at a second swivel axis of the joint, a recess is open in a V-shape to a rear longitudinal side, an opening angle being 60° to 120°.

16. The surface cleaning device according to claim 1, wherein beginning at a second swivel axis of the joint, a recess is open in a V-shape to a rear longitudinal side, an opening angle being 70° to 100°.

* * * * *